US011121442B2

(12) United States Patent
Choi et al.

(10) Patent No.: US 11,121,442 B2
(45) Date of Patent: Sep. 14, 2021

(54) WAVEGUIDE FOR CHANGING FREQUENCY RANGE BY USING SECTIONAL VARIABLE OF WAVEGUIDE AND FREQUENCY RANGE CHANGING METHOD

(71) Applicant: Electronics and Telecommunications Research Institute, Daejeon (KR)

(72) Inventors: Dahye Choi, Daejeon (KR); Kyung Hyun Park, Daejeon (KR); Il Min Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 88 days.

(21) Appl. No.: 16/588,271

(22) Filed: Sep. 30, 2019

(65) Prior Publication Data

US 2020/0313264 A1 Oct. 1, 2020

(30) Foreign Application Priority Data

Mar. 25, 2019 (KR) ..... 10-2019-0033676

(51) Int. Cl.
*H01P 1/207* (2006.01)
*H01P 3/127* (2006.01)

(52) U.S. Cl.
CPC ..... *H01P 1/207* (2013.01); *H01P 3/127* (2013.01)

(58) Field of Classification Search
CPC ..... H01P 1/207; H01P 3/127
USPC ..... 333/209, 212, 235, 251
See application file for complete search history.

(56) References Cited

U.S. PATENT DOCUMENTS

| | | | | |
|---|---|---|---|---|
| 8,390,922 | B1 | 3/2013 | Baehr-Jones et al. | |
| 8,772,725 | B2 | 7/2014 | Park et al. | |
| 8,878,635 | B2 * | 11/2014 | Miyamoto | H01P 1/207 333/209 |
| 9,947,980 | B2 | 4/2018 | Shih et al. | |
| 2005/0024167 | A1 * | 2/2005 | Rawnick | H01P 3/122 333/248 |
| 2012/0161905 | A1 | 6/2012 | Lee et al. | |
| 2013/0107356 | A1 | 5/2013 | Jeon et al. | |

FOREIGN PATENT DOCUMENTS

| | | | |
|---|---|---|---|
| CN | 107516752 | A | 12/2017 |
| JP | 2001330787 | A | 11/2001 |

* cited by examiner

*Primary Examiner* — Robert J Pascal
*Assistant Examiner* — Jorge L Salazar, Jr.
(74) *Attorney, Agent, or Firm* — William Park & Associates Ltd.

(57) ABSTRACT

Provided is a waveguide including an input end configured to receive an input wave from an outside; a filtering portion configured to change a frequency range of the input wave; an output end configured to output an output wave of which a frequency range is changed from the frequency range of the input wave; and an inner wall controller configured to control a size of an inner wall of the filtering portion such that the frequency range of the input wave changes to the frequency range of the output wave.

16 Claims, 6 Drawing Sheets

WAVEGUIDE FOR CHANGING FREQUENCY RANGE BY USING SECTIONAL VARIABLE OF WAVEGUIDE AND FREQUENCY RANGE CHANGING METHOD

CROSS-REFERENCE TO RELATED APPLICATION(S)

This application claims the priority benefit of Korean Patent Application No. 10-2019-0033676 filed on Mar. 25, 2019, in the Korean Intellectual Property Office, the disclosure of which is incorporated herein by reference for all purposes.

BACKGROUND

1. Field

One or more example embodiments relate to a waveguide capable of changing a frequency range of an electromagnetic wave passing through a waveguide and a method of changing a frequency range.

2. Description of Related Art

Terahertz (THz) wave refers to an electromagnetic wave that is present between a millimeter wave and infrared ray and has a frequency of 0.1 to 10 THz. Many materials such as paper, plastic and paint which are opaque in visible light are transparent in the THz wave, and this can be used for non-destructive test to inspect the internal structure of the materials. Also, a THz wave has a frequency range higher than that of a microwave or a radio wave and thus, advantageously transfer large capacity of information and acquire a high resolution image.

To keep pace with recent advances in the THz sources and detectors, THz devices such as waveguide, lens and filter are also demanding.

Metallic rectangular waveguides are typically used in the THz range and the transmitted THz frequencies through the waveguide are determined by the size of the dimension of the waveguide.

To change the frequency range to be used, the waveguide needs to be replaced that may result in the system realignment. This leads to increasing cost and using an amount of time for replacement.

Accordingly, there is a need for a method that can change a frequency range of an electromagnetic wave transmitted through a waveguide without replacing the waveguide.

SUMMARY

At least one example embodiment provides a waveguide for changing a frequency range of an electromagnetic wave passing through a waveguide without replacing the waveguide and a frequency range changing method of the waveguide.

According to an aspect of at least one example embodiment, there is provided a waveguide including an input end configured to receive an input wave from an outside; a filtering portion configured to change a frequency range of the input wave; an output end configured to output an output wave of which a frequency range is changed from the frequency range of the input wave; and an inner wall controller configured to control a size of an inner wall of the filtering portion such that the frequency range of the input wave changes to the frequency range of the output wave.

The filtering portion may include an outer wall of the filtering portion corresponding to a size of an outer wall of the waveguide; the inner wall of the filtering portion composed of a material of which the size can be tailored in response to external pressure; and an inner wall control material that is filled between the outer wall and the inner wall of the filtering portion and of which the volume is incremental or decremental.

The inner wall controller may include a pump configured to apply to an inner wall control material between an outer wall and the inner wall of the filtering portion; and a processor configured to determine an amount of the inner wall control material that is applied by the pump.

The processor may be configured to determine the amount of the inner wall control material that is applied between the outer wall and the inner wall of the filtering portion based on the required difference between the frequency range of the output wave and the frequency range of the input wave.

The inner wall controller may include a heating device configured to heat an inner wall control material positioned between an outer wall of the filtering portion and the inner wall of the filtering portion; and a processor configured to determine a power of the heating device. The inner wall control material may be a material that expands in response to the applied heat.

The processor may be configured to determine the power based on a difference between the frequency range of the output wave and the frequency range of the input wave.

The inner wall controller may be configured to decrease the size of the inner wall of the filtering portion when a higher frequency range needs to be selectively transmitted through the waveguide.

The inner wall controller may be configured to increase the size of the inner wall of the filtering portion when a lower frequency range needs to be selectively transmitted through the waveguide.

The filtering portion may be a multifilter including a plurality of filters, and the inner wall controller may be configured to differently control a size of an inner wall of each of the plurality of filters.

The inner wall controller may be configured to control sizes of inner walls to sequentially vary from a filter closest to the input end to a filter closest to the output end based on positions of the plurality of filters.

According to an aspect of at least one example embodiment, there is provided a frequency range changing method of a waveguide, the method including acquiring a target frequency range of an output wave that is output by passing through the waveguide; determining a diameter of an inner wall of a filtering portion of the waveguide corresponding to the target frequency range of the output wave; and controlling a size of the inner wall of the filtering portion such that the diameter of the inner wall of the filtering portion corresponds to the determined diameter of the inner wall.

The filtering portion may include an outer wall of the filtering portion corresponding to a size of an inner wall of the waveguide; the inner wall of the filtering portion formed of a material of which a size is variable in response to external pressure; and an inner wall control material provided between the outer wall of the filtering portion and the inner wall of the filtering portion and of which a volume is incremental or decremental.

The controlling may include increasing an amount of the inner wall control material that is applied between the outer wall of the filtering portion and the inner wall of the filtering portion according to a decrease in the determined diameter of the inner wall.

The controlling may include decreasing an amount of the inner wall control material that is applied between the outer wall of the filtering portion and the inner wall of the filtering portion according to an increase in the determined diameter of the inner wall.

The inner wall control material may be a material that expands in response to the applied heat, and the controlling may include increasing the power of a heating device according to a decrease in the determined diameter of the inner wall.

The inner wall control material may be a material that expands in response to the applied heat, and the controlling may include decreasing the power of a heating device according to an increase in the determined diameter of the inner wall.

According to some example embodiments, it is possible to change a frequency range of an electromagnetic wave that passes through a waveguide without replacing the waveguide by controlling a size of an inner wall of a filtering portion included in the waveguide.

Also, according to some example embodiments, it is possible to change a frequency range relatively quickly and at low cost by changing a frequency range of an electromagnetic wave that passes through a waveguide without replacing the waveguide. Also, it is possible to construct a system capable of easily performing optical alignment and variously coping with various situations.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
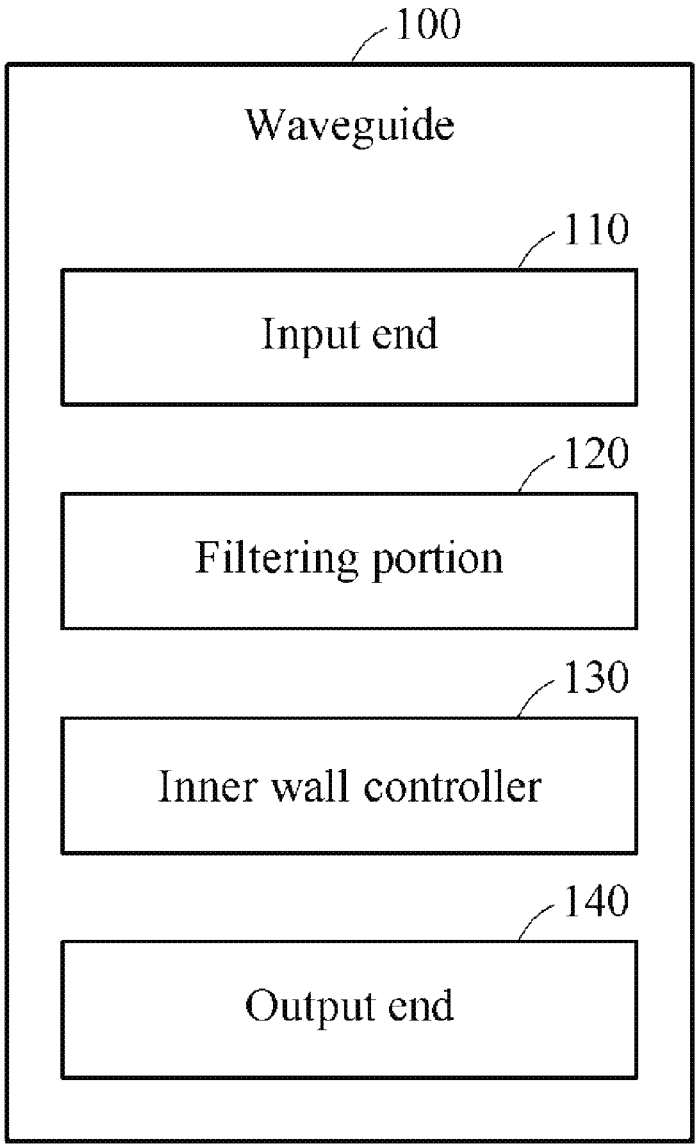
FIG. 1 is a diagram illustrating a waveguide according to an example embodiment.

Hereinafter, some example embodiments will be described in detail with reference to the accompanying drawings. The following detailed structural or functional description of example embodiments is provided as an example only and various alterations and modifications may be made to the example embodiments. Accordingly, the example embodiments are not construed as being limited to the disclosure and should be understood to include all changes, equivalents, and replacements within the technical scope of the disclosure.

Terms, such as first, second, and the like, may be used herein to describe components. Each of these terminologies is not used to define an essence, order or sequence of a corresponding component but used merely to distinguish the corresponding component from other component(s). For example, a first component may be referred to as a second component, and similarly the second component may also be referred to as the first component.

The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

A frequency range changing method according to example embodiments may be performed by a waveguide.

FIG. 1 is a diagram illustrating a waveguide according to an example embodiment.

Referring to FIG. 1, a waveguide 100 may include an input end 110, a filtering portion 120, an inner wall controller 130, and an output end 140. Here, the waveguide 100 may be a line through which an electromagnetic wave passes and may change a frequency range of the electromagnetic wave passing through the waveguide 100 under control of the inner wall controller 130. For example, the waveguide 100 may insert into a waveguide-type antenna.

The input end 110 may connect to an external input waveguide and may receive an input wave from the external input waveguide. Here, the input end 110 may be formed in a size, a diameter, and a shape corresponding to the external input waveguide. Also, the input wave may be an electromagnetic wave that is input to the waveguide 100 through the external input waveguide. For example, the frequency range of the input wave may be 50 gigahertz (GHz) to 3 terahertz (THz) that includes a portion of millimeter wave and terahertz wave range. Here, depending on example embodiment, the frequency range of the input wave may be outside 50 GHz to 3 THz.

The filtering portion 120 may change the frequency range of the input wave that is received in the input end 110. Here, the filtering portion 120 may include an outer wall of the filtering portion 120 corresponding to a size of an outer wall of the waveguide 100; an inner wall of the filtering portion 120 formed of a material of which a size is variable in response to external pressure; and an inner wall control material provided between the inner wall of the filtering portion 120 and the outer wall of the filtering portion 120 and of which a volume is incremental or decremental. For example, an inner wall of a filter may be made of a material, such as polyethylene.

The inner wall controller 130 may control the size of the inner wall of the filtering portion 120 to change the frequency range of the input wave to the frequency range of the output wave. Here, the output wave may be an electromagnetic wave of which a frequency range is changed from that of the input wave.

For example, the inner wall controller 130 may include a pump configured to apply an inner wall control material between the inner wall of the filtering portion 120 and the outer wall of the filtering portion 120, and a processor configured to determine an amount of the inner wall control material that is applied by the pump. Here, the processor may determine the amount of the inner wall control material that is applied between the inner wall of the filtering portion 120 and the outer wall of the filtering portion 120 based on a difference between the frequency range of the output wave and the frequency range of the input wave. For example, when the processor increases the amount of the inner wall control material that is applied between the inner wall of the filtering portion 120 and the outer wall of the filtering portion 120, the inner wall of the filtering portion 120 may receive the pressure due to the inner wall control material of which the amount is increased and the size of the inner wall of the filtering portion 120 may decrease.

Also, the inner wall controller 130 may include a heating device configured to heat the inner wall control material positioned between the inner wall of the filtering portion 120 and the outer wall of the filtering portion 120; and a processor configured to determine the power of the heating device. Here, the inner wall control material may be a material that expands in response to applying of heat. The processor may control the size of the inner wall of the filtering portion 120 by controlling the power of the heating device based on a difference between the frequency range of the output wave and the frequency range of the input wave. For example, when the processor increases the power of the heating device, the inner wall of the filtering portion 120 may be compressed due to the inner wall control material of which the volume is expanded by the heat and the size of the inner wall of the filtering portion 120 may decrease.

In the case of selecting the high frequency ranges of the output value from the frequency range of the input wave, the inner wall controller 130 may decrease the size of the inner wall of the filtering portion 120 based on the difference between the frequency range of the output value and the frequency range of the input value. Also, in the case of selecting the low frequency ranges of the output value from the frequency range of the input value, the inner wall controller 130 may increase the size of the inner wall of the filtering portion 120 based on the difference between the frequency range of the output value and the frequency range of the input value.

The output end 140 may connect to an external output waveguide and may output the output wave passing through the filtering portion 120 to the external output waveguide. Here, the output end 140 may be formed in a size, a diameter, and a shape corresponding to the external output waveguide.

The waveguide 100 according to an example embodiment may change the frequency range of the electromagnetic wave that passes through the waveguide 100 without replacing the waveguide 100 by controlling the size of the inner wall of the filtering portion 120 included in the waveguide 100.

Also, the waveguide 100 may change the frequency range of the electromagnetic wave that passes through the waveguide 100 without replacing the waveguide 100 and thereby may change the frequency range relatively quickly and at low cost compared to a conventional waveguide. Further, it is possible to construct a system capable of easily performing optical alignment and variously coping with various situations.

Figure 2:
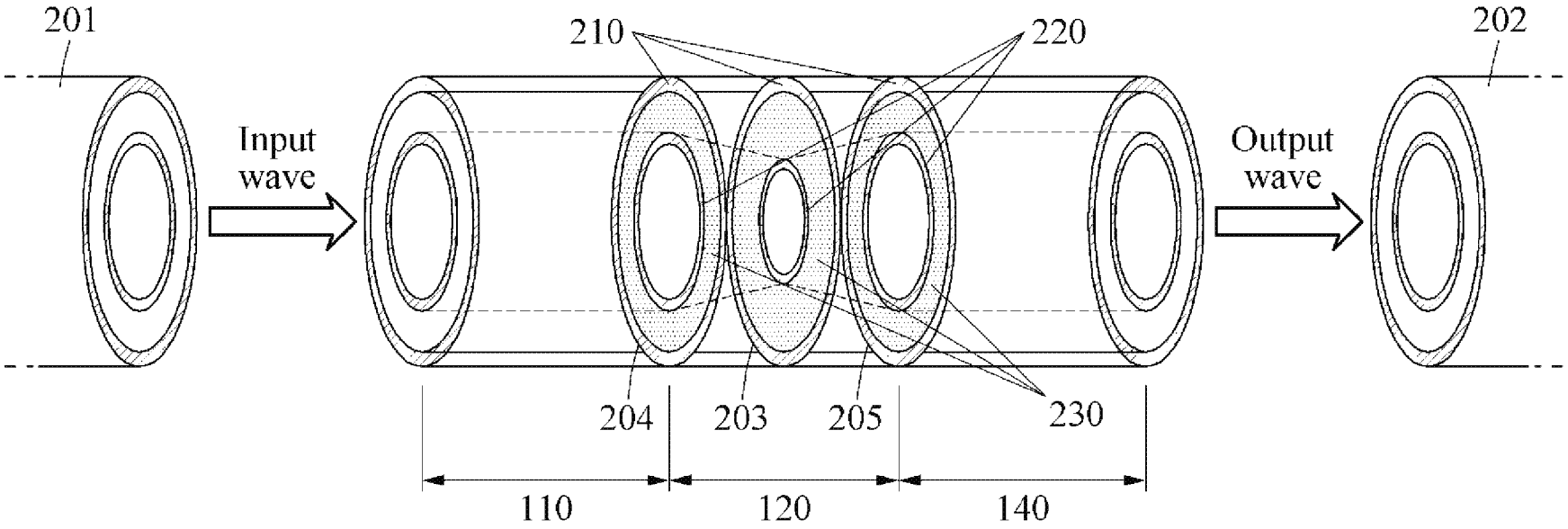
FIG. 2 illustrates an example of a waveguide according to an example embodiment.

FIG. 2 illustrates an example of a waveguide according to an example embodiment.

Although a cross-section of the waveguide 100 is in a circular shape of a metal waveguide, the cross-section of the waveguide 100 may be one of polygonal shapes, such as a circular shape, an oval shape, a triangular shape, and a rectangular shape, or other various two-dimensional (2D) figures.

Referring to FIG. 2, the input end 110 may transfer an input wave input from an external input waveguide 201 to the filtering portion 120.

Here, the filtering portion 120 may include an outer wall 210, an inner wall 220, and an inner wall control material 230. Also, the filtering portion 120 may be a multifilter that includes a plurality of filters, for example, first to third filters 203, 204, and 205. Here, the inner wall controller 130 may control a size of an inner wall of each of the plurality of filters 203, 204, and 205 to be different. For example, as illustrated in FIG. 2, the inner wall controller 130 may control a volume of the inner wall control material 230 of the first filter 203 to be greater than a volume of the inner wall control material 230 of each of the second filter 204 and the third filter 205, such that the size of the inner wall of the first filter 203 may be less than a size of the inner wall of each of the second filter 204 and the third filter 205.

Also, the inner wall controller 130 may control sizes of inner walls to sequentially vary from a filter closest to the input end 110 to a filter closest to the output end 140 based on positions of the plurality of filters. For example, the inner wall controller 130 may control the volume of the inner wall control material 230 such that the size of the inner wall of the second filter 204>size of the inner wall of the first filter 203>size of the inner wall of the third filter 205. Also, the inner wall controller 130 may control the volume of the inner wall control material 230 such that size of the inner wall of the second filter 204<size of the inner wall of the first filter 203<size of the inner wall of the third filter 205.

The inner wall controller 130 may control frequency ranges of electromagnetic waves that pass through the corresponding filters to suddenly change by maximizing a size difference between inner walls of the respective filters.

Also, a cutoff frequency of a TE11 mode that is a dominant mode in a waveguide may be determined according to Equation 1.

$$f_c = 1.8412c/2\pi a \quad \text{[Equation 1]}$$

In Equation 1, $f_c$ denotes the cutoff frequency of the TE11, c denotes speed of light, and a denotes a radius of an inner wall of a filter. That is, when the radius of the inner wall of the filter is decreased, the cutoff frequency of the output wave is increased.

Figure 3:
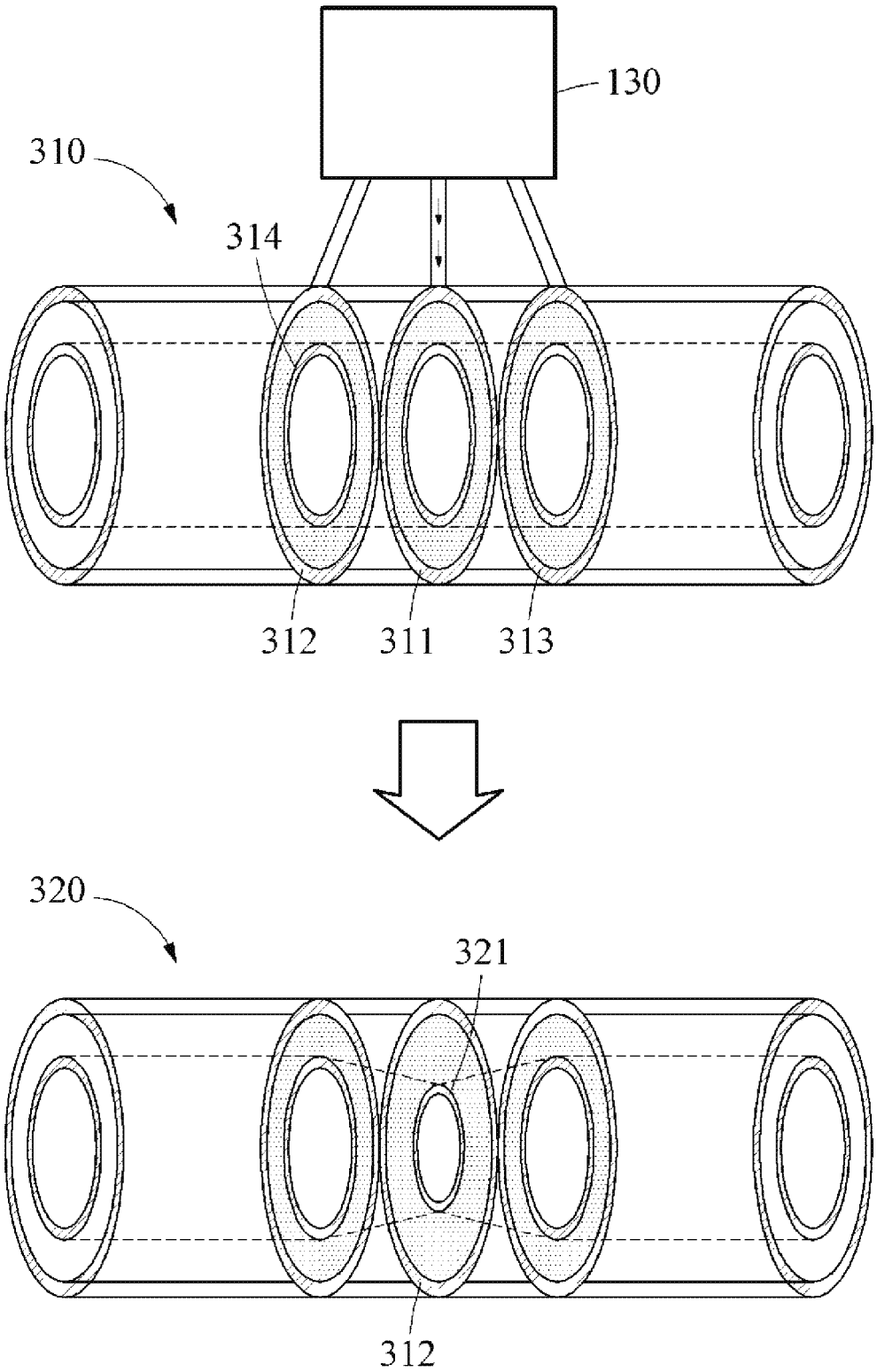
FIG. 3 illustrates an example of a frequency range changing operation of a waveguide according to an example embodiment.

FIG. 3 illustrates an example of a frequency range changing operation of a waveguide according to an example embodiment.

Referring to FIG. 3, in operation 310, the inner wall controller 130 may supply an inner wall control material only to a first filter 311 among the first filter 311, a second filter 312, and a third filter 313.

In operation 320, due to the inner wall control material supplied in operation 310, a size 321 of an inner wall of the first filter 311 may decrease to be less than a size 314 of an inner wall of the second filter 312. Accordingly, a cutoff frequency of an input wave that passes through the first filter 311 may increase to be greater than a cutoff frequency of an input wave that passes through the second filter 312.

Here, the inner wall control material may be liquid such as oil or water.

Figure 4:
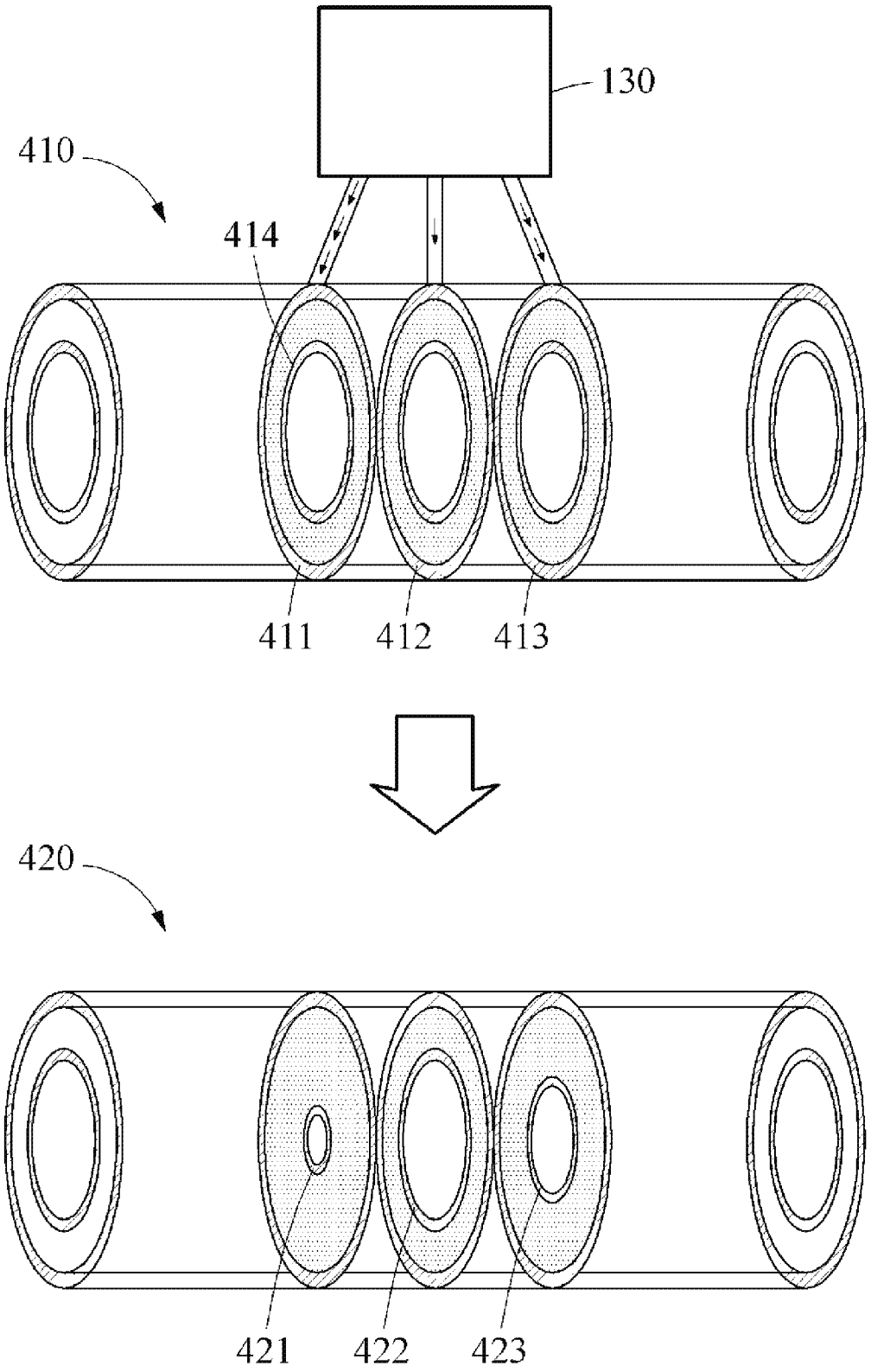
FIG. 4 illustrates another example of a frequency range changing operation of a waveguide according to an example embodiment.

FIG. 4 illustrates another example of a frequency range changing operation of a waveguide according to an example embodiment.

In operation 410, the inner wall controller 130 may apply a different amount of inner wall control material to each of a first filter 411, a second filter 412, and a third filter 413.

In operation 420, since a largest amount of inner wall control material is supplied to the first filter 411 in operation 410, a size 421 of an inner wall of the first filter 411 may be smallest due to the quantitively most increased inner wall control material. Accordingly, a cutoff frequency of an input wave that passes through the first filter 411 may be greater than a cutoff frequency of the input wave that passes through the second filter 412 and a cutoff frequency of the input wave that passes through the third filter 413.

Since a smallest amount of inner wall control material is supplied to the second filter 412 in operation 410, a size 422 of an inner wall may be largest due to the quantitively least increased inner wall control material. Accordingly, the cutoff frequency of the input wave that passes through the second filter 412 may be less than the cutoff frequency of the input wave that passes through the first filter 411 and the cutoff frequency of the input wave that passes through the third filter 413. In detail, the cutoff frequency of the input wave having increased while passing through the first filter 411 may decrease while passing through the second filter 412.

Since an intermediate amount of inner wall control material is supplied to the third filter 413 in operation 410, a size 423 of an inner wall may be between the size 421 of the inner wall and the size 422 of the inner wall. Here, since the size 423 of the inner wall is smaller than the size 422 of the inner wall, the cutoff frequency of the input wave having decreased while passing through the second filter 412 may increase while passing through the third filter 413. Here, since the size 423 of the inner wall is greater than the size 421 of the inner wall, the cutoff frequency of the input wave passing through the third filter 413 may be less than the cutoff frequency of the input wave having passed through the first filter 411 and having not passed through the second filter 422.

Figure 5:
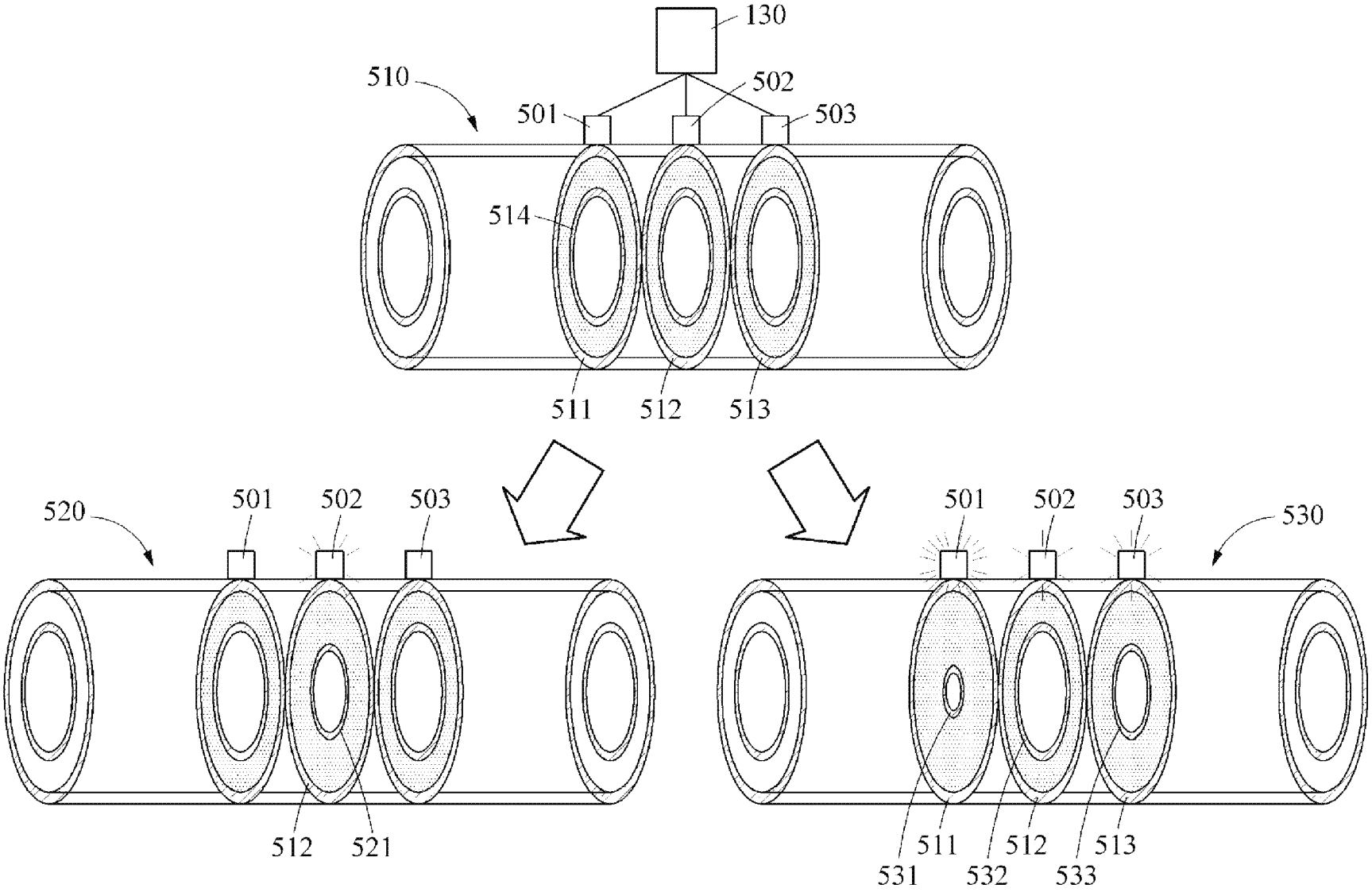
FIG. 5 illustrates another example of a frequency range changing operation of a waveguide according to an example embodiment.

FIG. 5 illustrates another example of a frequency range changing operation of a waveguide according to an example embodiment.

Referring to FIG. 5, in operation 510, the inner wall controller 130 may determine a power of each of a first heating device 501, a second heating device 502, and a third heating device 503 that are installed in a first filter 511, a second filter 512, and a third filter 513, respectively.

When the inner wall controller 130 determines to heat only the second heating device 502, operation 520 may be performed. When the inner wall controller 130 differently determines a power of each of the first heating device 501, the second heating device 502, and the third heating device 503, operation 530 may be performed.

In operation 520, since a volume of inner wall control material increases in response to heating the second heating device 502, a size 521 of an inner wall of the second filter 512 may decrease to be less than a size 514 of an inner wall of the first filter 511. Here, since the size 521 of the inner wall decreases to be less than the size 514 of the inner wall, a cutoff frequency of an input wave that passes through the second filter 512 may increase to be greater than a cutoff frequency of the input wave that passes through the first filter 511.

In operation 530, the first heating device 501, the second heating device 502, and the third heating device 503 may heat the inner wall control materials of the first filter 511, the second filter 512, and the third filter 513, based on powers determined by the inner wall controller 130, respectively. Here, the powers determined by the inner wall controller 130 may be in order of the first heating device 501>the third heating device 503>the second heating device 502.

Since a volume of inner wall control material increases most due to heating of the first heating device 501, a size 531 of the inner wall of the first filter 511 may be smallest. Accordingly, a cutoff frequency of an input wave that passes through the first filter 511 may be greater than a cutoff frequency of the input wave that passes through the second filter 512 and a cutoff frequency of the input wave that passes through the third filter 513.

Since a volume of inner wall control material increases smallest due to heating of the second heating device 502, a size 532 of the inner wall of the second filter 512 may be largest. Accordingly, the cutoff frequency of the input wave that passes through the second filter 512 may be less than the cutoff frequency of the input wave that passes through the first filter 511 and the cutoff frequency of the input wave that passes through the third filter 513. In detail, the cutoff frequency of the input wave having increased while passing through the first filter 511 may decrease while passing through the second filter 512.

Since a volume of inner wall control material increasing due to heating of the third heating device 503 corresponds to an intermediate level between the volume of the first filter 511 and the volume of the second filter 512, a size 533 of the inner wall may be a size between the size 531 of the inner wall and the size 532 of the inner wall. Here, since the size 533 of the inner wall is less than the size 532 of the inner wall, the cutoff frequency of the input wave having decreased while passing through the second filter 512 may increase while passing through the third filter 513. Here, since the size 533 of the inner wall is greater than the size 531 of the inner wall, the cutoff frequency of the input wave that passes through the third filter 513 may be less than the cutoff frequency of the input wave having passed through the first filter 511 and having not passed through the second filter 522.

Here, the inner wall control material of FIG. 5 may be a material having a relatively great coefficient of thermal expansion compared to other materials, such as, for example, water and ethanol. In detail, the waveguide 100 that requires a relatively high frequency conversion rate by the filtering portion 120 uses the inner wall control material of which a coefficient of thermal expansion is greater than or equal to a threshold. Accordingly, the volume of the inner wall control material may quickly increase compared to a time or a power.

Figure 6:
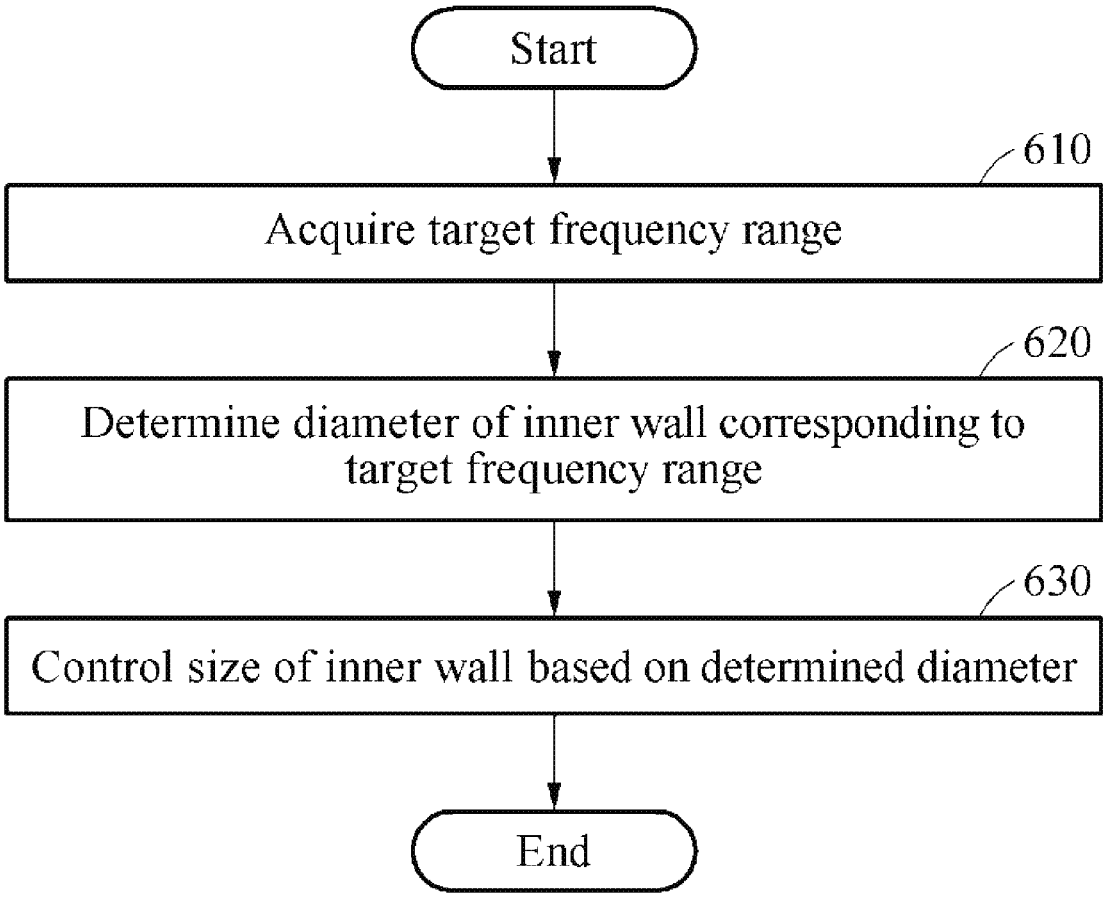
FIG. 6 is a flowchart illustrating a frequency range changing method of a waveguide according to an example embodiment.

FIG. 6 is a flowchart illustrating a frequency range changing method of a waveguide according to an example embodiment.

Referring to FIG. 6, in operation 610, the inner wall controller 130 may acquire a target frequency range of an output wave from at least one of a user, an external input device, and a communication apparatus. Here, the target frequency range may be a frequency range to be acquired for the output wave.

In operation 620, the inner wall controller 130 may determine a diameter of an inner wall corresponding to the target frequency range of the output wave acquired in operation 610. For example, the inner wall controller 130 may determine the diameter of the inner wall by substituting the target frequency range of the output wave for Equation 1.

In operation 630, the inner wall controller 130 may control a size of an inner wall of the filtering portion 120 to correspond to the diameter of the inner wall determined in operation 620. In detail, the inner wall controller 130 may adjust the size of the inner wall of the filtering portion 120 by controlling a volume of an inner wall control material applied to the filtering portion 120, such that the diameter of the inner wall of the filtering portion 120 may be identical to the diameter of the inner wall determined in operation 620 or may have a difference therewith by an error value or less.

Here, the inner wall controller 130 may determine an amount of inner wall control material that is applied between an outer wall of the filtering portion 120 and the inner wall of the filtering portion 120 based on the diameter of the inner wall determined in operation 620. For example, the inner wall controller 130 may increase an amount of inner wall control material that is applied between the outer wall of the filtering portion 120 and the inner wall of the filtering portion 120 according to a decrease in the diameter of the inner wall determined in operation 620. On the contrary, the inner wall controller 130 may decrease an amount of inner wall control material that is applied between the outer wall of the filtering portion 120 and the inner wall of the filtering portion 120 according to an increase in the diameter of the inner wall determined in operation 620.

Also, the inner wall controller 130 may control a power of a heating device configured to heat the inner wall control material based on the diameter of the inner wall determined in operation 620. For example, the inner wall controller 130 may increase a power of the heating device according to a decrease in the diameter of the inner wall determined in operation 620. On the contrary, the inner wall controller 130 may decrease a power of the heating device according to an increase in the diameter of the inner wall determined in operation 620.

According to example embodiments, it is possible to change a frequency range of an electromagnetic wave that passes through a waveguide without replacing the waveguide by controlling a size of an inner wall of a filtering portion included in the waveguide.

Also, according to example embodiments, it is possible to change a frequency range relatively quickly and at low cost by changing a frequency range of an electromagnetic wave that passes through a waveguide without replacing the waveguide. Also, it is possible to construct a system capable of easily performing optical alignment and variously coping with various situations.

The components described in the example embodiments may be achieved by hardware components including at least one DSP (Digital Signal Processor), a processor, a controller, an ASIC (Application Specific Integrated Circuit), a programmable logic element such as an FPGA (Field Programmable Gate Array), other electronic devices, and combinations thereof. At least some of the functions or the processes described in the example embodiments may be achieved by software, and the software may be recorded on a recording medium. The components, the functions, and the processes described in the example embodiments may be achieved by a combination of hardware and software.

The processing device described herein may be implemented using hardware components, software components, and/or a combination thereof. For example, the processing device and the component described herein may be implemented using one or more general-purpose or special purpose computers, such as, for example, a processor, a controller and an arithmetic logic unit (ALU), a digital signal processor, a microcomputer, a field programmable gate array (FPGA), a programmable logic unit (PLU), a microprocessor, or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will be appreciated that a processing device may include multiple processing elements and/or multiple types of processing elements. For example, a processing device may include multiple processors or a processor and a controller. In addition, different processing configurations are possible, such as parallel processors.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A waveguide comprising:

an input end configured to receive an input wave from an outside;

a filtering portion configured to change a frequency range of the input wave;

an output end configured to output an output wave of which a frequency range is changed from the frequency range of the input wave; and an inner wall controller configured to control a size of an inner wall of the filtering portion by applying heat or external pressure to inner wall control material located between the inner wall and an outer wall of the filtering portion, such that the frequency range of the input wave changes to the frequency range of the output wave.

2. The waveguide of claim 1, wherein:

the outer wall of the filtering portion corresponds to a size of an outer wall of the waveguide;

the size of the inner wall control material can be tailored in response to the heat applied or the external pressure; and the inner wall control material having a volume that is incremental or decremental.

3. The waveguide of claim 1, wherein the inner wall controller comprises:

a pump configured to apply the external pressure to the inner wall control material between the outer wall of the filtering portion and the inner wall of the filtering portion; and a processor configured to determine an amount of the external pressure applied to the inner wall control material by the pump.

4. The waveguide of claim 3, wherein the processor is configured to determine the amount of the external pressure being applied to the inner wall control material between the outer wall of the filtering portion and the inner wall of the filtering portion based on the required difference between the frequency range of the output wave and the frequency range of the input wave.

5. The waveguide of claim 1, wherein the inner wall controller comprises:

a heating device configured to heat the inner wall control material positioned between the outer wall of the filtering portion and the inner wall of the filtering portion; and a processor configured to determine a power of the heating device, and the inner wall control material is a material that expands in response to the applied heat.

6. The waveguide of claim 5, wherein the processor is configured to determine the power based on a difference between the frequency range of the output wave and the frequency range of the input wave.

7. The waveguide of claim 1, wherein the inner wall controller is configured to decrease the size of the inner wall of the filtering portion based on a difference between the frequency range of the output wave and the frequency range of the input wave in the case of increasing the cutoff frequency of the output wave compared to that of the input wave.

8. The waveguide of claim 1, wherein the inner wall controller is configured to increase the size of the inner wall of the filtering portion based on a difference between the frequency range of the output wave and the frequency range of the input wave in the case of decreasing the cutoff frequency of the output wave compared to that of the input wave.

9. The waveguide of claim 1, wherein the filtering portion is a multifilter comprising a plurality of filters, and the inner wall controller is configured to differently control a size of an inner wall of each of the plurality of filters.

10. The waveguide of claim 9, wherein the inner wall controller is configured to control sizes of inner walls to sequentially vary from a filter closest to the input end to a filter closest to the output end based on positions of the plurality of filters.

11. A frequency range changing method of a waveguide, the method comprising:

acquiring a target frequency range of an output wave that is output by passing through the waveguide;

determining a diameter of an inner wall of a filtering portion of the waveguide corresponding to the target frequency range of the output wave; and controlling a size of the inner wall of the filtering portion such that the diameter of the inner wall of the filtering portion corresponds to the determined diameter of the inner wall.

12. The method of claim 11, wherein the filtering portion comprises:

an outer wall of the filtering portion corresponding to a size of an inner wall of the waveguide;

the inner wall of the filtering portion formed of a material of which a size is variable in response to external pressure; and an inner wall control material provided between the outer wall of the filtering portion and the inner wall of the filtering portion and of which a volume is incremental or decremental.

13. The method of claim 12, wherein the controlling comprises increasing an amount of the inner wall control material that is applied between the outer wall of the filtering portion and the inner wall of the filtering portion according to a decrease in the determined diameter of the inner wall.

14. The method of claim 12, wherein the controlling comprises decreasing an amount of the inner wall control material that is applied between the outer wall of the filtering portion and the inner wall of the filtering portion according to an increase in the determined diameter of the inner wall.

15. The method of claim 12, wherein the inner wall control material is a material that expands in response to the applied of heat, and the controlling comprises increasing the power of a heating device according to a decrease in the determined diameter of the inner wall.

16. The method of claim 12, wherein the inner wall control material is a material that expands in response to the applied of heat, and the controlling comprises decreasing a power of a heating device according to an increase in the determined diameter of the inner wall.

* * * * *